United States Patent [19]

DuCorday

[11] 4,387,846

[45] Jun. 14, 1983

[54] BAG HANDLE

[76] Inventor: Gerard M. DuCorday, 10871 Thorley Rd., Santa Ana, Calif. 92705

[21] Appl. No.: 249,160

[22] Filed: Mar. 30, 1981

[51] Int. Cl.[3] ..... B65D 33/06

[52] U.S. Cl. ..... 229/54 R; 150/12

[58] Field of Search ..... 229/54 R, 52 A, 52 B; 150/3, 12

[56] References Cited

U.S. PATENT DOCUMENTS

| | | | |
|---|---|---|---|
| 2,788,121 | 4/1957 | Ayres | 206/45.33 |
| 3,140,038 | 7/1964 | Laguerre | 229/54 |
| 3,227,358 | 1/1966 | Laguerre | 229/54 |
| 3,266,053 | 8/1966 | Rochla | 93/35 |
| 3,282,493 | 11/1966 | Kamins et al. | 229/54 |
| 3,310,224 | 3/1967 | Laguerre | 229/54 |
| 3,313,470 | 4/1967 | Renner et al. | 229/54 |
| 3,339,823 | 9/1967 | Bessermann-Nielsen | 229/54 R |
| 3,339,823 | 9/1967 | Bessermann-Nielsen | 229/54 |
| 3,344,977 | 10/1967 | Kamins et al. | 229/54 |
| 3,353,741 | 11/1967 | Kamins et al. | 229/54 |
| 3,363,827 | 1/1968 | Renner et al. | 229/54 |
| 3,451,613 | 6/1969 | Vande Sande | 229/54 |
| 3,452,922 | 7/1969 | Hart | 229/54 |
| 3,459,362 | 8/1969 | Giachi | 229/54 R |
| 3,486,683 | 12/1969 | Kamins et al. | 229/54 R |
| 3,558,039 | 1/1971 | Schmidt | 229/54 R |

FOREIGN PATENT DOCUMENTS

| | | | |
|---|---|---|---|
| 706737 | 3/1965 | Canada | 220/9 |
| 800440 | 12/1968 | Canada | 229/54 R |
| 853527 | 10/1970 | Canada | 229/54 R |
| 1352070 | 5/1964 | France . | |
| 1372008 | 12/1964 | France . | |
| 1447571 | 11/1966 | France . | |
| 101337 | 12/1962 | Norway | 229/54 R |
| 840339 | 4/1958 | United Kingdom . | |
| 951232 | 3/1964 | United Kingdom . | |
| 1116904 | 6/1968 | United Kingdom | 229/54 R |

*Primary Examiner*—William Price
*Assistant Examiner*—Gary E. Elkins
*Attorney, Agent, or Firm*—Gausewitz, Carr, Rothenberg & Edwards

[57] ABSTRACT

A bag handle is formed of two complementary parts, each including a bail fixed to a pair of spaced legs. One bail has a hook and is shorter than the distance between the legs of the other handle part to allow the first bail to be passed through the other handle part. The two parts are arranged with interengaging, supporting shoulders and ledges to enable the second handle part to be supported from the hook on the first handle part, throughout the length of the handle.

16 Claims, 7 Drawing Figures

FIG. 7.
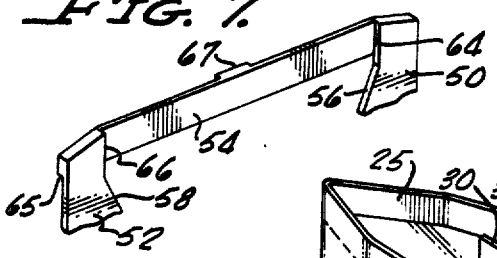
FIG. 1.
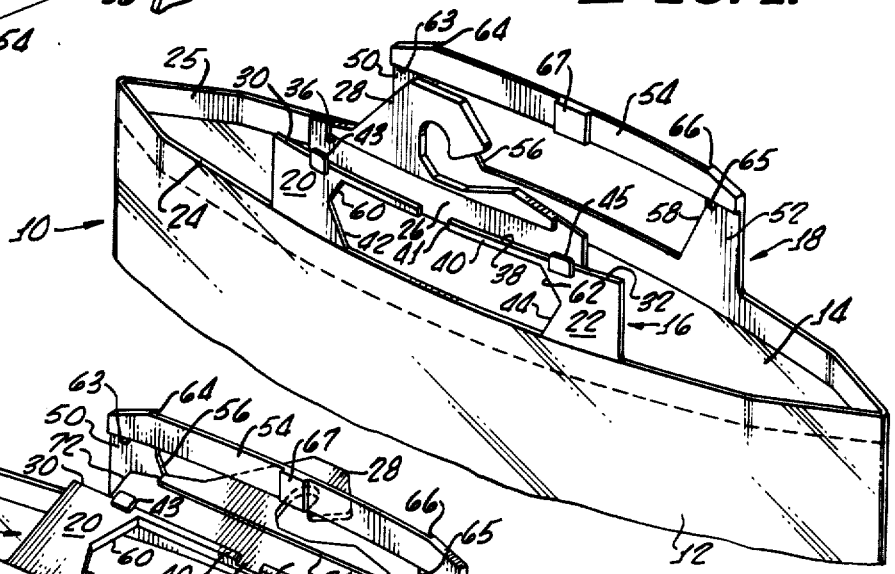
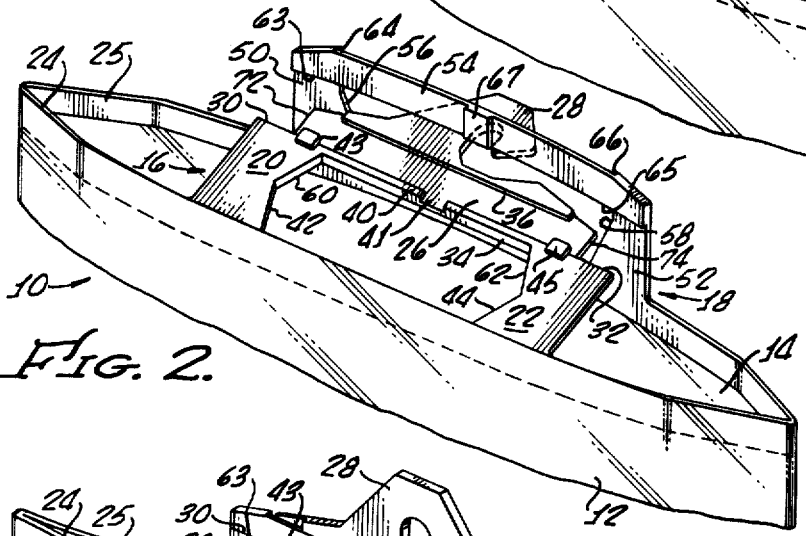
FIG. 2.
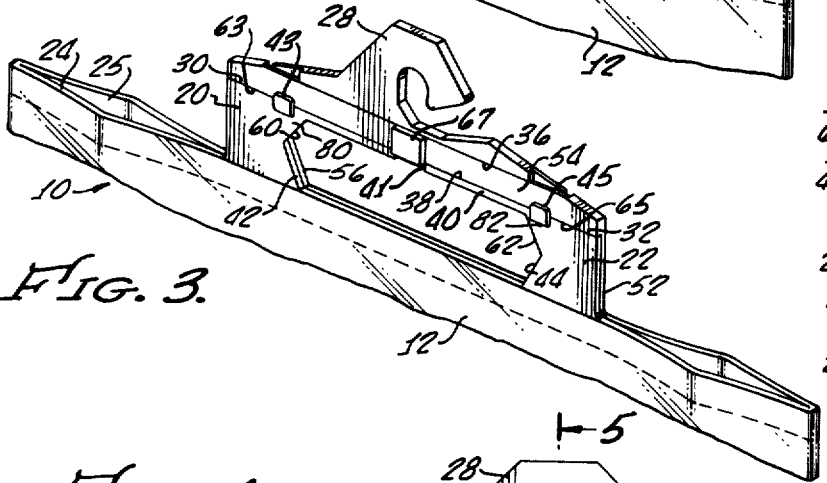
FIG. 3.
FIG. 5.
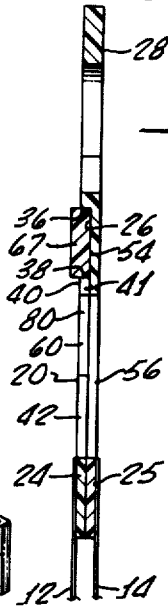
FIG. 6.
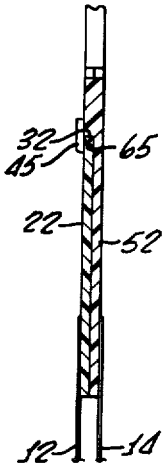
FIG. 4.
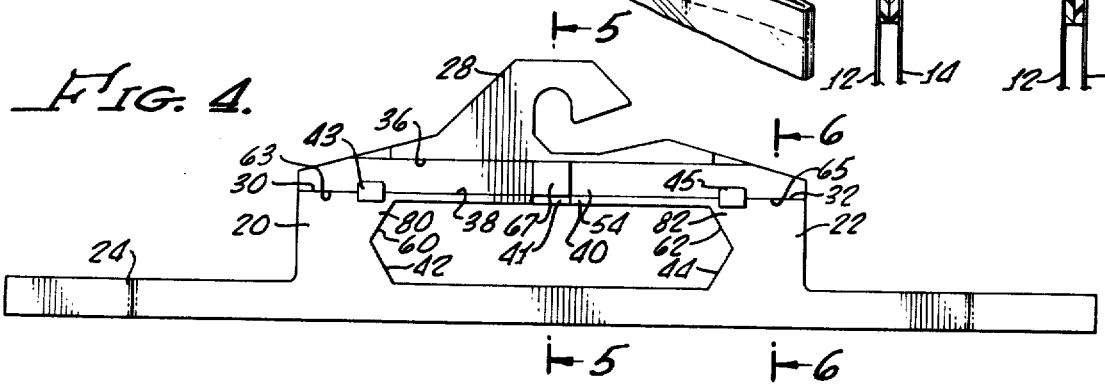

BAG HANDLE

BACKGROUND OF THE INVENTION

The present invention relates to bag handles and more particularly concerns a handle made of two interengaged and interlocked parts capable of being securely connected to one another and readily disengaged.

Open top bags of paper, cloth or plastic are frequently provided with a handle that serves also to close and lock the bag and, in some cases, also to hang it from a support. Such locking handles commonly comprise mating parts fixed to opposite sections of the upper rim of the open top bag, so that the two parts, when carried by hand, serve to both support the bag and hold it in a closed condition. Various resilient or snap type fittings are provided to secure the two handle parts to one another, and the two are often provided with complementary upstanding hooks by means of which the bag and its contents may be hung from a horizontal supporting rod. The required provision of special closing and locking devices, such as snap fasteners and resilient interfitting parts, adds to the complexity and cost of such handles. Yet, they are lacking in reliable locking of the parts and are often difficult to manipulate both in locking and unlocking. To provide adequate holding power for holding the two bag parts together, relatively small area snap-type fasteners require high dimensional precision and may require excessively large force to interengage the two parts.

Attempting to avoid some of these problems, a bag handle described in the patent to Bessermann-Nielsen, U.S. Pat. No. 3,339,823, makes the two handle parts of different size and shape so that all of one handle part may be inserted completely through the other. The larger part is provided with a hook to suspend the bag and also has a short flap to secure the smaller handle part in a closed position. The arrangement of this patent exhibits structural weakness, providing support for one-half of the bag handle solely from a relatively short small flap and inherently requires relatively narrow suspension legs, employing legs that are narrow at points where they are connected to the handle base rim.

Accordingly, an object of the present invention is to provide a supporting and self-locking bag handle that avoids or minimizes above-mentioned problems.

SUMMARY OF THE INVENTION

In carrying out principles of the present invention in accordance with a preferred embodiment thereof, mutually complementary primary and secondary handle parts each comprises a pair of mutually spaced legs and a bail extending between and secured to the legs. The bail of the primary part has a length less than the distance between the legs of the secondary part at the secondary part bail, so that the primary part bail can pass through the secondary part to position the outside surface of the primary part bail against the outside surface of the secondary part bail. According to another feature of the invention, the primary part legs do not pass through the secondary part, but are provided with means for engaging and supporting the secondary part. Because these legs are not required to pass through the other handle part, they may be made wider and stronger. For even further structural support and locking interengagement, one of the bails is provided with a supporting and locking channel that is adapted to receive, support and lock the other bail for at least a significant portion of the bail length. In closed position, the two complimentary halves of this handle become one strong mutually supporting and self-reinforcing unit.

BRIEF DESCRIPTION OF THE DRAWINGS

FIG. 1 is a perspective view of an upper section of an open top bag, in open condition, having a handle embodying principles of the present invention;

FIG. 2 is a view similar to FIG. 1 showing one handle part in the process of being passed through the other;

FIG. 3 is a similar view showing the bag and handle parts in locked and closed condition;

FIG. 4 is a side elevational view of the closed handle parts;

FIGS. 5 and 6 are sections taken respectively on lines 5—5 and 6—6 of FIG. 4; and FIG. 7 is a pictorial view of the outside of upper portions of the secondary handle part.

DETAILED DESCRIPTION

As illustrated in FIG. 1, the handle of the present invention is particularly adapted to be used with a flexible open top bag 10, having opposite sides 12, 14 to which the two integrally connected parts of a handle base rim are respectively secured. The bag 10 may be made of any suitable material, including paper, cloth or various types of transparent or opaque plastic, as is well known in the art. The handle comprises primary and secondary handle parts, 16, 18, that are substantially complementary, and circumferential base rim having opposite parts 24, 25.

Primary handle part 16 is formed of first and second mutually spaced suspension legs 20, 22, each fixed to and upstanding from the base rim part 24 that extends the length of the bag side 12 and is adapted to be fixedly secured to the upper edge of the bag, as by welding, stitching, riveting, gluing, or the like. Upper ends of legs 20 and 22 are interconnected by a horizontally extending bail 26 on the upper portion of which is formed a centrally located hanger hook 28.

Upper ends of each of legs 20 and 22 extend longitudinally outwardly in opposite directions from the ends of bail 26 to form upwardly facing supporting shoulders 30, 32 that are positioned below the upper edge of the bail and slightly above its lower edge 34.

Hook 28 is of increased thickness, preferably twice the thickness of the material from which the remainder of the handle part is formed, and is provided with a substantially straight lower edge 36 that forms one side (upper side) of a supporting and locking channel. The other side of this supporting and locking channel is formed by the upper edge 38 of a ledge 40, fixed to or formed on the outer surface of bail 26 at its lower edge. Ledge 40 extends for the full length of the bail and the full length of shoulders 30, 32. These shoulders form the outer ends of the ledge. For the length of the bail 26 the ledge 40 has a thickness equal to the increased thickness portion of hook 28, thus providing the lowermost edge of bail 26 with an increased or doubled thickness. Ledge 40 is discontinuous, having a centrally positioned gap 41 so that at this central portion, the lower edge of the bail is of lesser thickness.

Just inwardly of each shoulder 30, 32, are fixedly mounted respective holding tongues 43, 45 that extend upwardly, parallel to the surface of the bail 26, for a small distance above the upper surface of ledge 40.

Lower portions of suspension legs 20 and 22 converge away from the bail 26 as at 42, 44, to provide increased areas and thus greater strength for the legs at the points at which they are attached to the base rim part 24, which forms the top rim of an attached bag.

Secondary handle part 18 similarly includes first and second mutually spaced legs 50, 52 fixed to and upstanding from a base rim part 25 that extends the length of the bag side and is adapted to be fixedly secured to the bag side 14 in the same fashion that base rim part 24 is secured to bag side 12. Legs 50, 52 are interconnected at their upper ends by a horizontally extending bail 54 that extends across and overlaps the uppermost ends of the legs. Legs 50, 52 have mutually facing inner edges 56, 58 converging toward base rim part 25 so that lower portions of these inner edges are aligned with converging lower edges 42, 44 of the legs of the primary handle part. However, the inner edges 56, 58 of the secondary handle part are substantially straight, converging continuously downwardly and inwardly from just below their junction with the bail 54, whereas upper portions 60, 62 of the inner edges of legs 20, 22 diverge downwardly and outwardly from bail 26 toward their intersection with edge portions 42, 44, thus providing a somewhat V-shaped configuration for inner edges of each of the legs of the primary handle part.

Importantly, the length of bail 26 of the primary handle part is less than the distance between inner edges 56, 58 of the secondary part legs 50, 52 at the junction of such legs with the bail 54. This enables the primary part bail 26, together with its hanger hook 28, to be inserted through the secondary handle part in the manner illustrated in FIG. 2. Primary part legs 20, 22, however, have their end portions 30, 32 mutually spaced by a distance greater than the maximum distance between the legs of the secondary part and thus the primary part legs cannot pass through the secondary handle part near bail 54.

The overlapping of bail 54 and legs 50, 52 causes upper and outer corners of the secondary handle part to be of a greater thickness to provide mutually facing abutment areas 64, 66 on the inner edges of the upper portions of legs 50, 52. Abutment areas 64, 66 abut the ends 72, 74 of bail 26 when the handle parts are closed. Similarly the overlapping of bail 54 and legs 50, 52 provide downwardly facing bail abutment areas 63, 65 that abut the shoulders 30, 32, when the handle parts are closed.

A thumb tab in the form of a central portion 67 of increased thickness is fixed to the inner surface of bail 54 so that its lower edge is in registry with the gap 41 of ledge 40, providing a relatively great thickness, unobstructed by ledge 40, to be pressed by the thumb of a user, as will be described below.

The channel formed in the primary handle part, between the lower edge 36 of the thickened hanger hook and the upper edge 38 of intermediate support ledge 40 is congruent with the secondary part bail 54 for the length of the latter, excepting only the bail ends which overlap legs 50, 52. Accordingly, when the primary handle part bail 26, together with its hook 28, is inserted through the secondary handle part, the inner surface of the bail 26, which forms the bottom of the supporting channel, will snugly engage the outer surface of bail 54 as the latter is received within the channel. Holding tongues 43, 45 engage the surface of bail 54, extending slightly above its lower edge, and thus further help to retain bail 54 within the channel. The holding tongues extend partly across the channel 36, 38 to hold the bail 54 therein. Bail 54 is a close fit within the channel when the handle parts are in closed position as shown in FIGS. 3, 4, 5 and 6. In such closed position, legs 20, 22, which do not and cannot pass through the secondary part, lie with their inner surfaces against the inner surfaces of the secondary handle part legs 50, 52. Abutment areas 63, 65 engage and are supported upon the upwardly facing shoulders 30, 32. Proper relative longitudinal positioning of the two handle parts is ensured by engagement of abutment areas 64, 66 of secondary handle part legs 50, 52 with outer end edges 72, 74 of bail 26.

The base rim parts are formed of resilient strips integrally connected to each other at their ends. They are bent at their connected ends, so that the major portions of the lengths of the base rim parts are slightly spaced from one another in unstressed condition, as illustrated in FIGS. 1 and 2. These parts, having resilience and shape memory that causes them to tend to return to unstressed configuration, must be slightly twisted and brought closer together when closing the handle parts. This resiliency stresses the handle parts, and particularly the base rim parts, which accordingly impart forces to the bails that tend to more securely hold them in their interlocked, closed position.

The handle configuration and its resilience prevent accidental opening of the handle parts. To open the handle parts requires raising bail 54 relative to bail 26, a motion that is resisted by the interlocking engagement of the bail 54 in the locking channel. Furthermore, because the integral base rim part 25 must also be raised relative to base rim part 24 to open the bag and disengage the handle parts, the base rim must be twisted to open the bag and its resilient stiffness inherently resists such opening.

The configurations of the legs of the first and second handle parts are substantially congruent, except for the difference caused by the triangular diverging portions 80, 82 of the legs 20, 22 at points adjacent bail 26. Longitudinally outer edges of legs of the two parts are preferably aligned with one another and may have any desired shape or inclination, provided that the dimension of such legs along the length of base rim parts 24, 25 is sufficient to provide adequate strength at these points.

It will be noted that the handle parts are easily closed and locked together. One merely and quite naturally inserts the projecting hook part through the secondary handle part 18; thus carrying bail 26 through the secondary handle part. This brings shoulders 30, 32 into engagement with abutment areas 63, 65 and longitudinally aligns the two handle parts by engagement of ends 72, 74 of bail 26 with the abutment areas 64, 66. Bail 54 may then be simply and readily snapped into locking and supporting position within the channel formed between the lower edge 36 of the hook and edge 38 of ledge 40, being automatically locked within the channel by the holding tongues 43, 45 and the resilience of the base rim. In such a condition, the two handle parts are securely locked in position with respect to one another, being positively and directly aligned longitudinally, vertically and transversely. Moreover, because a hook is provided on only one of the handle parts, the secondary handle part, which has no hook, must be supported entirely from the first handle part when the bag is to be suspended from the hook. In the described arrangement, the secondary handle part is supported from the primary handle part for the entire length of the handle.

Further, the interlocking interengagement, along the full length of the handle, significantly rigidifies the locked handle parts, thus further ensuring retention of the parts in locked condition and providing superior load capacity and increased resistance to bending and other distortion. The need for a hook on only one handle part decreases material and manufacturing costs and enhances simplicity of use. The thumb tab 67 facilitates opening of the bag parts, providing a relatively large lower surface, unobstructed by ledge 40, to be pressed upwardly and outwardly by a thumb while other fingers of the same hand press outwardly and downwardly on the hook 28. This causes the bail 26 to be pressed out of the locking channel and away from the holding tongues 43, 45.

If the increased strength and rigidity provided by the locking and supporting channel 36, 38 is not necessary in a particular application, ledge 40 may be eliminated and support of the second handle part is provided entirely from shoulders 30, 32. However, it is to be noted that ledge 40 not only provides a portion of the locking and supporting channel but also affords an increased thickness of the lower portion of bail 26, and thus provides increased comfort in carrying the bag. The described arrangement of channel 36, 38 receiving the secondary part bail 54 is presently preferred, but it will be readily appreciated that different configurations may be employed. For example, bail 54 may itself be provided with a channel to receive a thickened portion or longitudinally extending ledge or rib (not shown) projecting from the outer surface of the bail 26, thus in effect reversing the positions of the channel and the part received by the channel. Ledge 40 also provides stiffening and increased strength for bail 26.

The handle parts are conventionally molded of plastic materials well known to those skilled in the art and commonly used for handles of this general type. Preferably, the handle parts, including base rim parts, are molded integrally and the two handle parts are themselves molded integrally with one another by molding the two with the base rim parts 24, 25 integrally connected at their outermost longitudinal ends.

The foregoing detailed description is to be clearly understood as given by way of illustration and example only, the spirit and scope of this invention being limited solely by the appended claims.

What is claimed is:

1. A bag handle having mutually complimentary primary and secondary handle parts, each adapted to be connected to a bag section, each said handle part comprising a pair of mutually spaced legs and a bail extending between and secured to said legs, the bail of said primary part having a length less than the distance between the legs of said secondary part at the bail of said secondary part, whereby the bail of said primary part can pass through said secondary part to position the outside surface of said primary part bail against the outside surface of said secondary part bail, said primary part legs extending beyond said primary part bail and having end portions mutually spaced by a distance greater than the distance between the legs of said secondary part, whereby said primary part legs cannot pass through said secondary part, and a hanger secured to one of said handle parts.

2. The bag handle of claim 1 including means on said primary part legs for engaging and supporting said secondary part.

3. The bag handle of claim 1 wherein said hanger is secured to said primary handle part, wherein said primary part legs have supporting shoulders, and including means on said secondary part for engaging said supporting shoulders, whereby said secondary part is supported from said hanger.

4. The bag handle of claim 1 including an intermediate supporting ledge on the surface of one of said bails in supporting engagement with the other of said bails for a major portion of the length of said bails.

5. A bag handle having mutually complimentary primary and secondary handle parts, each adapted to be connected to a bag section, each said handle part comprising a pair of mutually spaced legs and a bail extending between and secured to said legs, the bail of said primary part having a length less than the distance between the legs of said secondary part at the bail of said secondary part, whereby the bail of said primary part can pass through said secondary part to position the outside surface of said primary part bail against the outside surface of said secondary part bail, each leg of said primary part having an outwardly extending supporting shoulder, and each end of said secondary part having an abutment area in supported engagement with a respective one of said shoulders.

6. The handle of claim 5 including an intermediate supporting ledge on said primary part bail engaging and supporting said secondary part bail between said abutments.

7. The handle of claim 6 wherein said hanger is secured to said primary part bail, whereby said secondary handle part is supported from said hanger by means of said shoulders, abutments and ledge.

8. The handle of claim 7 wherein said secondary part bail has a thumb tab fixed to an intermediate portion of an inner surface thereof to facilitate disengagement of said primary and secondary part bails.

9. The handle of claim 8 including at least one holding tongue on said ledge, extending above the ledge and engaging a surface of the secondary part bail.

10. A bag handle having mutually complimentary primary and secondary handle parts, each adapter to be connected to a bag section, each said handle part comprising a pair of mutually spaced legs and a bail extending between and secured to said legs, the bail of said primary part having a length less than the distance between the legs of said secondary part at the bail of said secondary part, whereby the bail of said primary part can pass through said secondary part to position the outside surface of said primary part bail against the outside surface of said secondary part bail, inner edges of said primary part legs converging away from said primary part bail, lower portions of said primary part legs being substantially congruent with lower portions of said secondary part legs, and a hanger secured to said primary part bail.

11. A bag handle for supporting, handling, closing and hanging an open top bag, said handle comprising first and second base rim parts adapted to be secured to the top of a bag, a first handle part having first and second spaced legs fixed to said first base rim part and upstanding therefrom, each leg having an outer edge forming an upwardly facing support shoulder, and a first bail fixed to upper ends of said legs and extending between said shoulders, a second handle part having third and fourth legs fixed to said second base rim part and upstanding therefrom, a second bail fixed to said third and fourth legs and extending between said abutment areas, ends of said second bail having abutment areas adapted to engage respective ones of said support shoulders, and hook means fixed to one of said bails for suspending said handle, and a bag secured thereto.

12. The handle of claim 11 wherein the length of said first bail is less than the distance between said third and fourth legs at said second bail, whereby said first bail can be passed through said second handle part.

13. The handle of claim 12 including an intermediate supporting ledge on the outer surface of said first bail adapted to engage and support said second bail.

14. The handle of claim 12 including a channel formed in an outer surface of said first bail, said second bail being received in said channel.

15. A bag handle for supporting, handling, closing and hanging an open top bag, said handle comprising first and second bag base rim parts adapted to be secured to the top of a bag, a first handle part having first and second spaced legs fixed to said first base rim part and upstanding therefrom, and a first bail fixed to and extending between upper ends of said legs, said bail including a hook portion of increased thickness, said bail further including a downwardly facing channel edge, and an intermediate supporting ledge having an upwardly facing channel edge spaced from said downwardly facing channel edge, and defining therewith a channel, a second handle part having third and fourth legs fixed to and upstanding from said second base rim part, and a second bail fixed to and extending said third and fourth legs, said second bail having an intermediate portion thereof congruent with and received in and supported by said channel, said third and fourth legs being mutually spaced by a distance greater than the length of said first bail.

16. The bag handle of claim 11 including upwardly facing shoulders on said first and second legs and downwardly facing abutments on said second handle part at ends of said second bail for engaging said shoulders to support said second handle part upon said first handle part.

* * * * *